US005873713A

United States Patent [19]

Osterhues

[11] Patent Number: 5,873,713

[45] Date of Patent: Feb. 23, 1999

[54] FUEL/AIR SUPPLY ASSEMBLY FOR GAS BURNERS

[76] Inventor: Konrad Osterhues, 12 Burning Oak Trail, Barrington, Ill. 60010

[21] Appl. No.: 691,987

[22] Filed: Sep. 13, 1996

[51] Int. Cl.[6] ..... F23D 14/62

[52] U.S. Cl. ..... 431/354; 29/890.02; 29/521

[58] Field of Search ..... 431/354; 126/39 R, 126/41 R, 39 E; 29/890.02, 890.039, 505, 521, 524; 239/566

[56] References Cited

U.S. PATENT DOCUMENTS

| | | | |
|---|---|---|---|
| 2,541,710 | 2/1951 | Miller | 239/416.5 |
| 3,728,779 | 4/1973 | Behlen et al. | 29/521 |
| 3,981,064 | 9/1976 | Hafner | 29/521 |
| 4,760,634 | 8/1988 | Rapp | 29/521 |
| 5,517,743 | 5/1996 | Liebig et al. | 29/521 |

FOREIGN PATENT DOCUMENTS

| | | | |
|---|---|---|---|
| 1224218 | 3/1971 | United Kingdom | 126/40 |

*Primary Examiner*—Carl D. Price
*Attorney, Agent, or Firm*—Terrence Martin; Jules Jay Morris; Sean Detweiler

[57] ABSTRACT

A pair of spaced tubular half-shells are stamped in each of two separate sheets of metal which are then joined at their margins to form two mixer tubes each having an inlet end with a venturi for connection to a fuel gas supply and an outlet end adapted for connection to a burner. The space between the mixer tubes is stamped to form a pair of grooves which lock and seal the sheets together to prevent the fuel/air mixture from leaking from one mixer tube to the other.

11 Claims, 2 Drawing Sheets

FUEL/AIR SUPPLY ASSEMBLY FOR GAS BURNERS

BACKGROUND OF THE INVENTION

The present invention relates to the supply of fuel and air mixture to a gaseous fuel burner and particularly relates to supplying a fuel/air mixture to gaseous fuel burners employed for cooking. In particular, the invention relates to supplying a fuel/air mixture to gaseous fuel burners for rangetops and cooktops utilized in household cooking appliances which are manufactured in high volume mass production.

Heretofore, the tubular supply arrangements for the fuel/air mixture, or mixer tubes widely used in the manufacture of household rangetop and cooktop burners have been formed with an individual air-aspirating venturi tube connected for supplying the top burners individually from a gas supply manifold. It is known to form the fuel/air venturi supply or mixer tubes by stamped shells or half tubes joined together at their margins to form a completed tube assembly. In a co-pending application, Ser. No. 609,203 filed Mar. 1, 1996 entitled "Mixer Tube Assembly For Fuel Gas Burner" and assigned to the assignee of the present invention, it was disclosed to form the fuel/air supply or mixer tube for plural top burners from stamped half shells formed from individual sheets of material joined together to form individual spaced venturi mixer tubes or passages for connection at the inlet end of the tubes to a manifold and at the outlet end to individual burners. However, in fabricating such plural burner mixer tubes from sheet material and joining the sheets, it has been found that there is leakage of the fuel/air mixture between the sheets from one tube to the other. If this leakage is not controlled, the fuel/air mixture can flow between the passages and to a burner which has not been ignited, thereby creating a hazardous condition.

Accordingly, it has been desired to provide a relatively low cost way or means of forming a fuel/air supply or mixer tube assembly from individually formed shells made from sheet stock and joined in such a manner as to prevent leakage between the individual burner tube passages and in such a was as to minimize the manufacturing costs.

SUMMARY OF THE INVENTION

The present invention provides a fuel/air supply or mixer tube assembly for plural gas burners in which half shells are formed from individual sheets of stock and joined together peripherally to form spaced plural supply tubes, each having an inlet adapted for connection to a supply manifold and an outlet adapted for connection to an individual burner. The region of the sheet stock intermediate the spaced supply passages is sealed by forming integrally in the sheets ridges or grooves by metal deformation which prevents flow of the fuel/air mixture between the individual burner passages. The deformation of the metal sheet stock may be performed by stamping, embossing, coining or rolling and may be done partially or wholly prior to the joining of the individually formed half shells of sheet stock.

DETAILED DESCRIPTION

Figure 1:
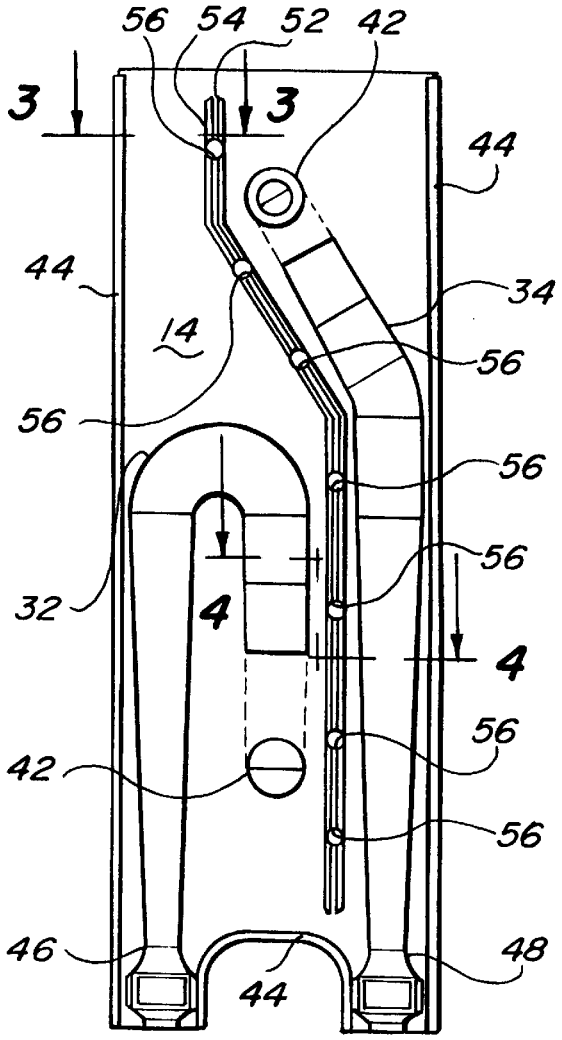
FIG. 1 is a plan view of the assembled air/fuel supply assembly of the present invention.
Figure 2:
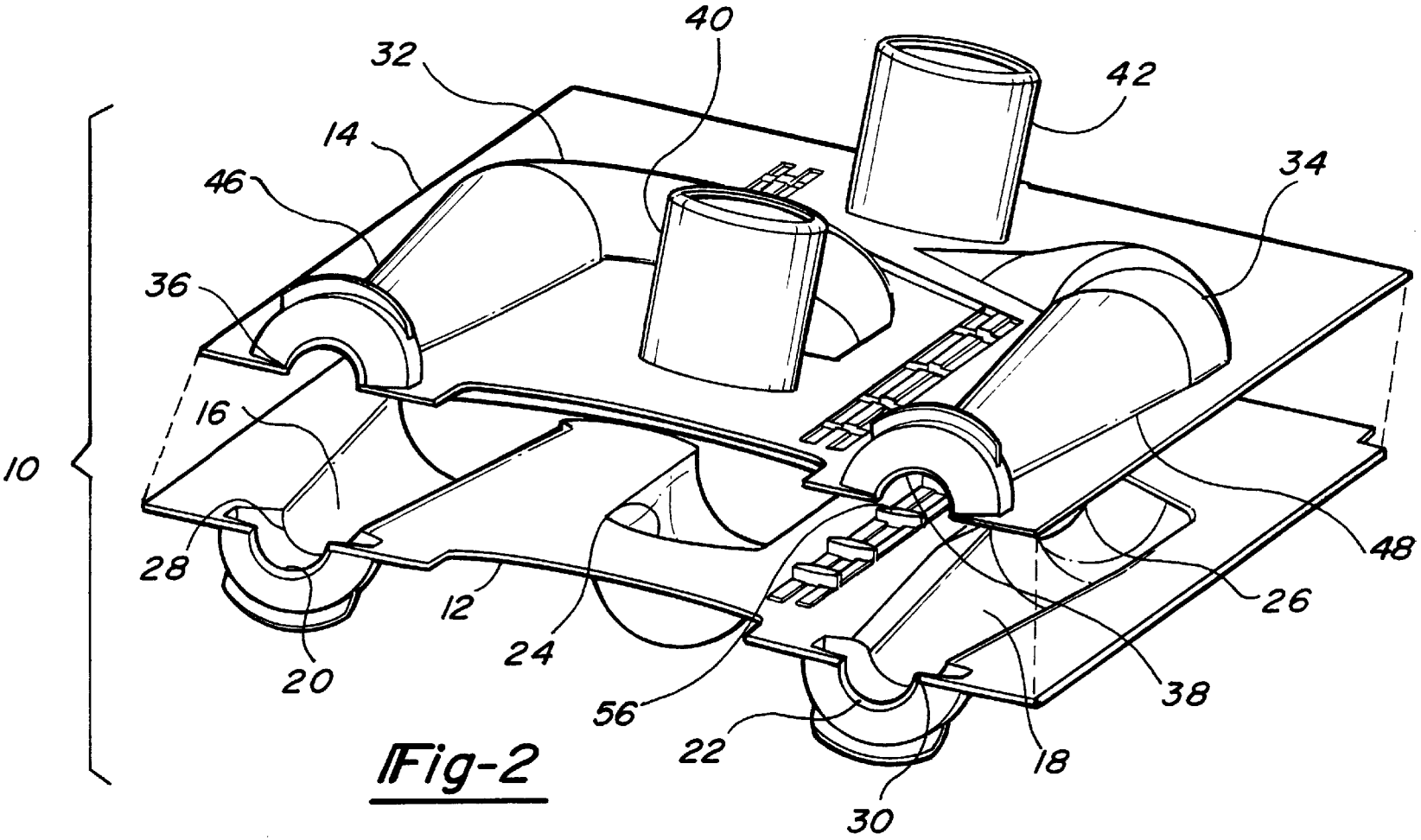
FIG. 2 is an exploded top view of the assembly of FIG. 1.

Referring to FIGS. 1 and 2, the supply assembly of the present invention is indicated generally at 10 and includes a first or lower sheet of material 12 having formed therein such as by stamping a first hollow or shell portion 16. The first sheet 12 has a second shell 18 formed therein spaced from the shell 16 formed in the lower sheet 12 have and which shells have, respectively, inlet ends 20, 22 and outlet ends 24, 26, with a venturi or converging-diverging nozzle portions respectively 28, 30 formed adjacent the inlets 20, 22.

The upper shells are similarly stamped from sheet material 14 to form another half of the first and second fuel/air passages, which upper shells are denoted by reference numerals 32, 34 having respectively inlet sections 36, 38 and outlet sections respectively 40, 42 adapted for connection to the inlet of individual fuel gas burners (not shown). In the presently preferred practice of the invention, the sheets 12, 14 are formed of metallic material and preferably material selected from the group consisting essentially of galvanized or zinc-coated steel, corrosion resistant steel and stainless steel; however, it will be understood that other suitable metals may be employed if desired.

Figure 3:
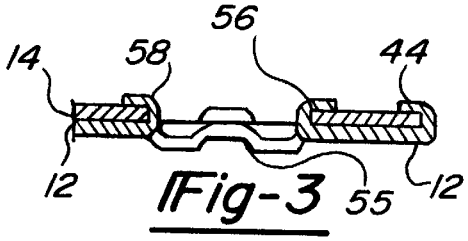
FIG. 3 is a section view taken along section indicating lines 3—3 of FIG. 1; and, FIG. 4 is a section view taken along section indicating lines 4–4 of FIG. 1.

The upper and lower sheets 14, 12 are secured together at their margins by folding the edges of one sheet over the other as illustrated in FIGS. 1 and 3 which illustrate the folded portion of the lower sheet 12 over the edge of the upper sheet 14 as denoted by reference numeral 44. The assembly of the upper and lower shells 16, 18 and 32, 34 thus form a first and second fuel/air mixture passage adapted for communicating between a supply of gas connected to the inlet and individual fuel burners connected to the outlets. The upper half shell portions 32, 34 also have venturi or converging-diverging nozzle sections 46, 48 formed adjacent the inlet sections 36, 38.

Figure 4:
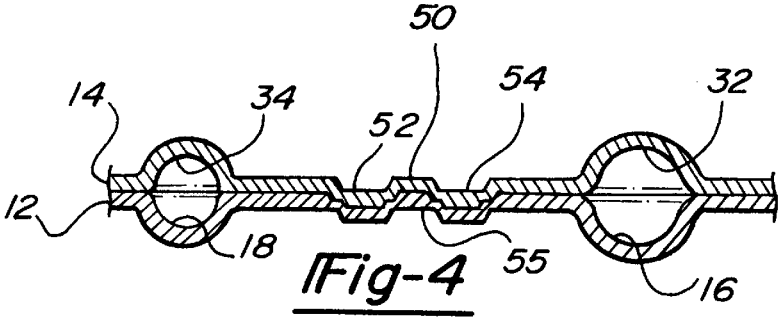

Referring to FIGS. 1 and 4, a seal means indicated generally at 50 is formed in the region intermediate the fuel/air passages by deforming the metal of the sheets 14, 12 in a pair of spaced grooves or valleys denoted by reference numerals 52, 54 and 55. In the presently preferred practice of the invention, the grooves 52, 54 and 55 are formed in a die such as to lock together the portions of the two sheets 12, 14 by metal deformation to form the seal means 50. In the present practice it has been satisfactory to form the grooves by one of the methods selected from the group consisting of stamping, coining, embossing and rolling.

Referring to FIGS. 1 and 3, at selected intervals along the grooves 52, 54, apertures denoted by reference numerals 56 are formed in the material of the sheets 12, 14 in the region of seal means 50 by punching and piercing with a tool (not shown) through the sheets to form a flange 56 which is flared or riveted outwardly over the sheet 14 to provide a clamping function in the region of the seal means 50. It will be understood that the aforesaid operations of folding the edges 44, forming the seal means 50 including grooves 52, 54 and 55 and forming the apertures 56 and flanges 58 may be performed progressively in suitable dies.

The present invention thus provides a unique and novel structure and method for making a plurality of fuel/air supply or mixing passages in an assembly having inlets for the passages adapted for connection to a fuel gas manifold and outlets at the opposite ends of the passages adapted for connection to individual fuel gas burners and which is formed of two single sheets of material in a simple to fabricate and relatively low cost manner.

Although the present invention has hereinabove been described with respect to the illustrated embodiments, it will be understood that the invention is capable of modification and variation and is limited only by the following claims.

I claim:

1. A fuel/air supply assembly for plural fuel gas burners comprising:

(a) a first shell formed from a sheet of material and having portions thereof integrally formed to define generally one-half of a first and second fuel/air passage having an inlet and outlet;

(b) a second shell formed integrally from a sheet of material and having portions integrally formed to define generally another half of said first and second fluid/air passage having an inlet and outlet; wherein said first and second shells are joined together about the periphery to form said first and second fuel/air inlet and outlet supply passage for said burners, said first and second inlets adapted for connection to a fuel gas source and said first and second outlets adapted for connection to a first and second fuel/air burner;

(c) seal means formed integrally in said first and second shell intermediate said first and second passages and operative to substantially prevent passage of fuel/air mixture between said first and second passages, such that said first and second passages are not in fluid communication within said assembly and between said inlet and outlet; and said seal means including a pair of spaced generally parallel grooves each commonly formed in said first and second shell in superposed arrangement.

2. The assembly defined in claim 1, wherein said seal means includes means clamping said first and second shells together.

3. The assembly defined in claim 1, wherein said seal means includes at least one groove formed in each of said first and second shell at a common station in superposed arrangement.

4. The assembly defined in claim 1, wherein said first and second passages include a converging-diverging section.

5. The assembly defined in claim 1, wherein said seal means includes clamping means having a plurality of spaced apertures with portions of the edges thereof of one of said first and second sheet folded over the other of said first and second sheet.

6. The assembly defined in claim 1, wherein said first and second sheets are formed of metallic sheet material.

7. The assembly defined in claim 1, wherein at least one of said first and second fuel/air passages have a venturi formed adjacent the inlet.

8. The assembly defined in claim 1, wherein said first and second shells are formed of material selected from the group consisting of galvanized steel, corrosion resistant steel and stainless steel.

9. A fuel/air supply assembly for plural fuel gas burners comprising:

(a) a first shell formed from a sheet of material and having portions thereof integrally formed to define generally one-half of a first and second fuel/air passage having an inlet and outlet;

(b) a second shell formed integrally from a sheet of material and having portions integrally formed to define generally another half of said first and second fluid/air passage having an inlet and outlet; wherein said first and second shells are joined together about the periphery to form said first and second fuel/air inlet and outlet supply passage for said burners, said first and second inlets adapted for connection to a fuel gas source and said first and second outlets adapted for connection to a first and second fuel/air burner;

(c) seal means formed integrally in said first and second shell intermediate said first and second passages and operative to substantially prevent passage of fuel/air mixture between said first and second passages, such that said first and second passages are not in fluid communication within said assembly and between said inlet and outlet; and said seal means has a generally "W" shaped configuration in transverse section.

10. A fuel/air supply assembly for plural fuel gas burners comprising:

(a) a first shell formed from a first sheet of material and having portions formed to define generally one-half of a first and a second fluid passage having an inlet and an outlet;

(b) a second shell formed integrally from a sheet of material having portions integrally formed to define generally another half of said first and second fluid passages, and having an inlet and an outlet, wherein said first and second shells are joined together about the periphery to form said first and second fluid passages, said first and second inlets being adapted for connection to a fuel gas source and said first and second outlets being connected to a first and second burner; and (c) said shells being generally planar at a location intermediate said first and second passages, said first and second shells being deformed out of said planar shape between said first and second passages to form at least one groove to provide a seal to prevent passage of fluid between said first and second passages; and said seal is provided by two deformed grooves such that the cross-sectional configuration of said seal is generally W-shaped.

11. An assembly as recited in claim 10, wherein said seal prevents passage of fluid between said first and second passages within said assembly.

* * * * *